US006894242B2

(12) United States Patent
Müller et al.

(10) Patent No.: US 6,894,242 B2
(45) Date of Patent: May 17, 2005

(54) ROTARY LIGHT SWITCH

(75) Inventors: Klaus Müller, Aach (DE); Jürgen Girke, R ichenau (DE); Karl-Heinz Wohlfahrt, Ludwigshafen (DE)

(73) Assignee: TRW Automotive Electronics & Components GmbH & Co. KG, Radolfzell (DE)

( * ) Notice: Subject to any disclaimer, the term of this patent is extended or adjusted under 35 U.S.C. 154(b) by 0 days.

(21) Appl. No.: 10/622,686

(22) Filed: Jul. 18, 2003

(65) Prior Publication Data

US 2004/0016630 A1 Jan. 29, 2004

(30) Foreign Application Priority Data

Jul. 19, 2002 (DE) ..... 102 32 985

(51) Int. Cl.[7] ..... H01H 19/20
(52) U.S. Cl. ..... 200/568; 200/336
(58) Field of Search ..... 200/564, 336, 200/19.03, 19.2, 329, 304, 317, 568–574

(56) References Cited

U.S. PATENT DOCUMENTS

| | | | | |
|---|---|---|---|---|
| 3,243,528 A | | 3/1966 | Brady | |
| 3,770,926 A | | 11/1973 | Wanner | |
| 4,227,058 A | | 10/1980 | Johnston et al. | |
| 4,518,832 A | * | 5/1985 | Geremia | 200/4 |
| 4,945,195 A | * | 7/1990 | Ipcinski | 200/6 B |
| 5,546,067 A | * | 8/1996 | Schmidt et al. | 200/4 |
| 5,594,220 A | * | 1/1997 | Hackbarth et al. | 200/6 B |
| 5,939,683 A | * | 8/1999 | Hoskins et al. | 200/5 R |
| 6,079,401 A | * | 6/2000 | Alvord et al. | 200/6 B |
| 6,236,002 B1 | | 5/2001 | Chou | |

FOREIGN PATENT DOCUMENTS

| | | | | |
|---|---|---|---|---|
| DE | 3834390 C1 | | 12/1989 | |
| DE | 3412518 C2 | | 5/1993 | |
| DE | 4215694 A1 | | 12/1993 | |
| DE | 4215694 | | 12/1993 | |
| DE | 19840060 A1 | | 3/2000 | |
| EP | 0242875 | | 10/1987 | |
| GB | 1400116 A | * | 7/1975 | H01H/19/20 |

* cited by examiner

*Primary Examiner*—Lincoln Donovan
*Assistant Examiner*—M. Fishman
(74) *Attorney, Agent, or Firm*—Tarolli, Sundheim, Covell & Tummino L.L.P.

(57) ABSTRACT

The rotary light switch for motor vehicles has a housing (10) and an actuating member (14) mounted rotatably. In a peripheral wall (24) of the housing, a cam surface (26) is recessed, which runs in peripheral direction and rises axially facing axially away from the actuating member. A cam follower (22) projects radially from the actuating member (14) and runs up on the cam surface on rotation of the actuating member, bearing only axially on the cam surface and forcing the actuating member (14) to move axially.

6 Claims, 2 Drawing Sheets

ROTARY LIGHT SWITCH

FIELD OF THE INVENTION

The present invention relates to a rotary light switch with a housing and an actuating member mounted rotatably in the housing. Such rotary light switches are usual in motor vehicles.

BACKGROUND OF THE INVENTION

Rotary light switches for motor vehicles usually have the switch positions "off", "parking light" and "traffic light", between which a switching over is carried out by rotating the actuating member, and additional switch positions for "fog light" or "front fog light" and "rear fog light", between which a switching over is carried out by axial movement of the actuating member. As the fog light is only permissible in combination with traffic light or at least parking light, measures are provided, by which particular combinations of rotary position/axial position of the actuating member are prevented. From the DE 38 34 390 C1 a rotary light switch is known, the actuating member of which has two control pins which are urged radially outwards by spring force. The outer ends of these pins are rounded in a spherical shape and run in a guide channel arranged on the inner face on the housing. The guide channel is provided with profile tracks which on the one hand form various detent zones to define the switch positions, and on the other hand have axially rising zones which force upon the actuating member an axial movement component on rotation over particular peripheral areas of the profile tracks. The guide channel has a complex geometry and is therefore difficult to produce. Since the control pins are pressed radially outwards against the profile tracks, movement of the actuating member is opposed by considerable friction, so that relatively high actuating forces are necessary.

BRIEF SUMMARY OF THE INVENTION

The invention provides a rotary light switch which is particularly simple to realize and permits reduced actuating forces. In the rotary light switch according to the invention, a cam surface is provided on the housing, which runs in peripheral direction rising axially and also facing axially away from the actuating member. On the actuating member, a radially projecting cam follower is provided, which on rotation of the actuating member runs up on the cam surface and only rests axially thereon. Ideally, the cam follower bears on the cam surface without any radial component. Consequently, when the cam follower runs up on the axially rising cam surface, only axial forces are produced which are required for the axial movement of the actuating member. The cam surface has a very simple geometry. It preferably consists of a section, for example rising linearly axially, and of a section adjoining thereto, which does not rise axially.

In the preferred embodiment, the cam surface is formed by a recess in a peripheral wall, which is formed on the inner face on a ring-shaped switch shield surrounding the actuating member.

BRIEF DESCRIPTION OF THE SEVERAL VIEWS OF THE DRAWINGS

Further features and advantages of the invention will be apparent from the following description of a preferred embodiment with reference to the enclosed drawings. In the drawings.

DETAILED DESCRIPTION OF THE INVENTION

Figure 1:
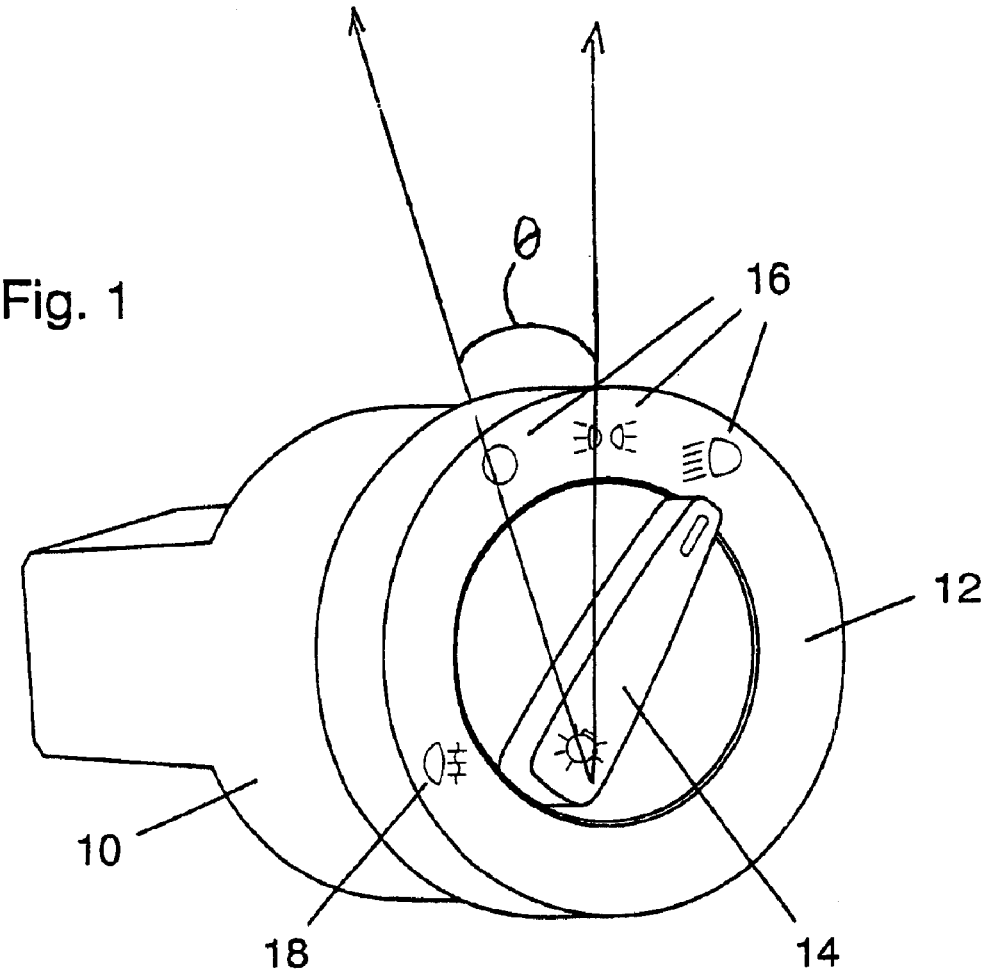
FIG. 1 shows a perspective view of the rotary light switch.
Figure 3:
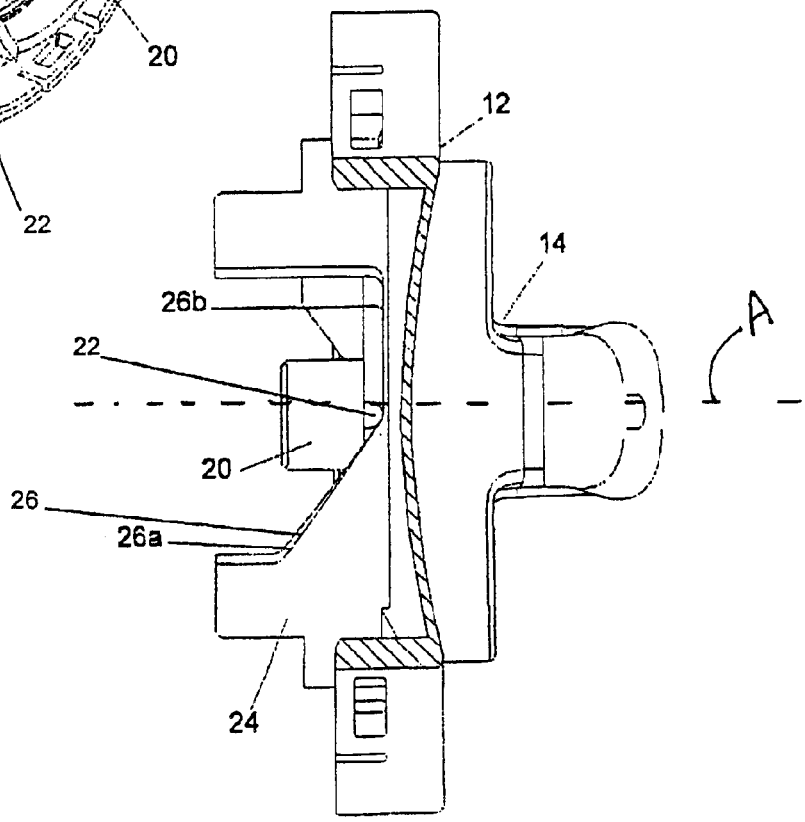
FIG. 3 shows a sectional view of the control piece shown in FIG. 2.

The rotary light switch shown in FIG. 1 has a generally circular-cylindrical housing 10 with a ring-shaped switch shield 12 on the end face, which coaxially surrounds an actuating member 14 in the form of a rotary knob which is rotatable about axis A (FIG. 3). The switch shield is provided with symbols 16 to indicate the rotary positions of the actuating member 14. The angle θ corresponds to the rotation angle between two adjacent switch positions. A further symbol 18 on the switch shield 12 is associated with an axial position of the rotary light switch. The switch shield 12 is fitted over the front end of the housing 10.

Figure 2:
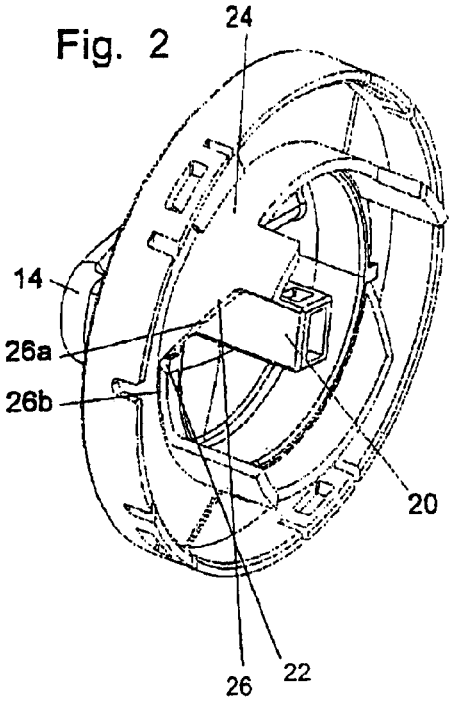
FIG. 2 shows a perspective view of a control piece of the rotary light switch.

As can be seen from FIG. 2, the actuating member 14 has an axial drive hub 20, with which a switch shaft of a switch mechanism (not shown) is coupled so as to be connected for joint rotation and axially fixed. In addition, the actuating member 14 has a cam follower 22 in the form of a pin, projecting radially outwards, which is formed at the outer end of a radial finger. A generally cylindrical peripheral wall 24, coaxial to the actuating member 14, is formed on the housing 10. In the peripheral wall 24, a recessed cam surface 26 is formed, which cam surface 26 consists of two sections 26*a*, 26*b* adjoining each other. The section 26*a* of the cam surface 26 has an axially rising surface, facing away from the actuating member 14; the section 26*b* of the cam surface 26 likewise has a surface facing away from the actuating member 14, which, however, does not rise axially. On rotation of the actuating member 14, the cam follower 22 runs up axially on the section 26*b* of the cam surface 26. By further rotation of the actuating member 14, an axial movement is forced upon it in the direction of the axial rise of the section 26*a* of the cam surface 26.

In FIG. 3 the possible axial switch positions of the actuating member 14 are indicated. The cam follower 22 is located at the transition between the sections 26*a*, 26*b* of the cam surface 26 corresponding to an axial switch position adjusted by pulling on the actuating member 14. In this axial switch position, the fog light is activated. At the same time, owing to the rotary position of the actuating member 14, a vehicle light is activated, for example the parking light. In the same axial switch position, the actuating member 14 can be rotated in a clockwise direction, in order to adjust the next rotary position, in which for example the traffic light is switched on. If, on the other hand, the actuating member 14 is turned from the rotary position shown in FIG. 3 by rotation in an counterclockwise direction into the "off" switch position, the curve follower 22 runs up on the axially rising section 26*a* of the cam surface 26, so that the actuating member 14 is forced to an axial switch position in which the fog light is switched off.

The cam surface 26 can be produced easily with any desired shape in accordance with design requirements. In the embodiment shown, the axially rising section 26*a* rises linearly; depending on the desired switching feel, the path can be progressive or degressive. As the cam follower 22 only bears in axial direction on a narrow cam surface 26, minimal friction occurs, so that the rotating light switch can be operated at a reduced actuating force.

What is claimed is:

1. A rotary light switch with a housing and with an actuating member mounted rotatably about an axis in said housing, said housing comprising a ring-shaped switch shield surrounding said actuating member and surrounding a cylindrical peripheral wall connected to said switch shield and being coaxial with said actuating member and being formed with a cam surface which rises axially in a direction facing away from said actuating member, said actutating member having a radially projecting cam follower which bears axially on said cam surface on rotation of said actuating member forcing said actuating member to move axially.

2. The rotary light switch according to claim 1, wherein the cam follower bears on the cam surface without a radial component of movement.

3. The rotary light switch according to claim 1, wherein the cam surface is formed by a recess in the peripheral wall.

4. The rotary light switch according to claim 1, wherein the cam surface rises linearly axially.

5. The rotary light switch according to claim 1, wherein the cam surface has an axially rising section and an axially non-rising section adjoining thereto in peripheral direction.

6. The rotary light switch according to claim 1, wherein the axially rising cam surface extends over a rotation angle which corresponds to a rotation of the actuating member between two adjacent switch positions.

* * * * *